US011220804B2

(12) United States Patent
Muehlbauer et al.

(10) Patent No.: US 11,220,804 B2
(45) Date of Patent: Jan. 11, 2022

(54) HYDRAULIC PRESSURIZING MEDIUM SUPPLY ASSEMBLY FOR A MOBILE WORK MACHINE, AND METHOD

(71) Applicant: Robert Bosch GmbH, Stuttgart (DE)

(72) Inventors: Florian Muehlbauer, Neu-Ulm (DE); Michael Brand, Ulm (DE); Minha An, Weissenhorn (DE); Salih Tetik, Nersingen (DE); Ximing Wang, Neu-Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/938,418

(22) Filed: Jul. 24, 2020

(65) Prior Publication Data

US 2021/0025138 A1 Jan. 28, 2021

(30) Foreign Application Priority Data

Jul. 26, 2019 (DE) ..... 10 2019 120 329.5
Dec. 12, 2019 (DE) ..... 10 2019 219 451.6

(51) Int. Cl.
*E02F 9/22* (2006.01)
*F15B 15/24* (2006.01)

(52) U.S. Cl.
CPC ..... *E02F 9/2235* (2013.01); *F15B 15/24* (2013.01)

(58) Field of Classification Search
CPC . E02F 9/2235; F15B 2211/6656; F15B 15/24; F15B 21/087; F15B 2211/665
See application file for complete search history.

(56) References Cited

U.S. PATENT DOCUMENTS 4,801,247 A 1/1989 Hashimoto et al.
4,809,504 A * 3/1989 Izumi ..... F04B 49/065 60/430

(Continued)

FOREIGN PATENT DOCUMENTS

DE 3532931 A1 4/1987
DE 103 52 851 A1 6/2005
DE 10 2016 222 139 A1 5/2018
EP 0 349 092 B1 1/1990

(Continued)

OTHER PUBLICATIONS

Bosch Rexroth AG, "Pressure and flow control system," Data Sheet RE 30630/04.13, 2013 (English language equivalent to RD 30630/04.13) (28 pages).

(Continued)

*Primary Examiner* — Abiy Teka
(74) *Attorney, Agent, or Firm* — Maginot, Moore & Beck LLP

(57) ABSTRACT

A hydraulic pressurizing medium supply assembly has an adjustable axial piston machine. An actuating cylinder is controlled by way of a pilot valve. The pilot valve is actuated by a control installation. The control installation, as input variables, has an actual pressure and/or an actual swivel angle of the adjustable axial piston machine. One or a plurality of the input variables are compared with a matching nominal value and a control value is emitted, or in each case a control value is emitted. The controlling of the input variables is part of a first closed-loop control circuit. An underlying second closed-loop control circuit has an input variable which is based on the control variable or the control variables and serves as a nominal variable. A further input variable of the second closed-loop control circuit is an actual delivery-volume adjustment rate of the axial piston machine.

15 Claims, 10 Drawing Sheets

(56) References Cited

U.S. PATENT DOCUMENTS

| | | | | |
|---|---|---|---|---|
| 4,967,557 | A * | 11/1990 | Izumi | E02F 9/2025 60/423 |
| 5,170,625 | A | 12/1992 | Watanabe et al. | |
| 5,182,908 | A | 2/1993 | Devier et al. | |
| 5,267,441 | A | 12/1993 | Devier et al. | |
| 5,527,156 | A * | 6/1996 | Song | F15B 11/16 417/2 |
| 5,967,756 | A | 10/1999 | Devier et al. | |
| 9,546,468 | B2 * | 1/2017 | Bang | E02F 9/2285 |
| 2011/0276212 | A1 * | 11/2011 | Wu | B60L 50/16 701/22 |
| 2015/0075148 | A1 * | 3/2015 | Yamaji | F15B 13/06 60/420 |

FOREIGN PATENT DOCUMENTS

| | | |
|---|---|---|
| EP | 0 381 784 A1 | 8/1990 |
| EP | 1 460 505 A2 | 9/2004 |
| EP | 2 851 565 B1 | 3/2015 |

OTHER PUBLICATIONS

Bosch Rexroth AG, "External control electronics for the SYDEF1 adjustment of the A10VSO axial piston pump," Data Sheet RE 30242/03.10, 2010 (English language equivalent to RD 30242/03 10) (12 pages).

Bosch Rexroth AG, "Electro-hydraulic Control system DFE1," Data Sheet RE 92088/08.04, 2004 (English language equivalent to RD 92088/08.04) (12 pages).

* cited by examiner

HYDRAULIC PRESSURIZING MEDIUM SUPPLY ASSEMBLY FOR A MOBILE WORK MACHINE, AND METHOD

This application claims priority under 35 U.S.C. § 119 to (i) patent application no. DE 10 2019 120 329.5, filed on Jul. 26, 2019 in Germany, and (ii) patent application no. DE 10 2019 219 451.6, filed on Dec. 12, 2019 in Germany. The disclosures of the above-identified patent applications are both incorporated herein by reference in their entirety.

The disclosure relates to a hydraulic pressurizing medium supply assembly for an open hydraulic circuit, for example for mobile work machines.

BACKGROUND

A pressure and flow control system is known from document RD 30630/04.13 of the Rexroth company. Said pressure and flow control system serves for the electro-hydraulic control of a swivel angle, pressure and power of an axial piston variable-displacement pump. The control system has an axial piston variable-displacement pump with an electrically actuated proportional valve. A set piston can be actuated by way of said proportional valve. Said set piston serves for adjusting a swash plate of the variable-displacement pump. A displacement transducer by way of which a swivel angle of the swash plate can be determined by way of the displacement path of the set piston is provided for the set piston. As an alternative to the displacement transducer, a swivel angle of the swash plate can also be detected on the pivot axle by way of a Hall sensor. The volumetric flow of the variable-displacement pump can in turn be ascertained from the swivel angle of the swash plate. The variable-displacement pump is driven by a motor. When the variable-displacement pump is not being driven and pressure is absent in the actuating system, the variable-displacement pump, on account of a spring force of a spring, pivots toward a maximum delivery volume. In contrast, the variable-displacement pump in the driven state of the variable-displacement pump and with a non-energized pilot valve and a closed pump outlet pivots toward a zero-stroke pressure. An equilibrium between the pump pressure at the set piston and the spring force of the spring is established at approximately 4 to 8 bar. The initial position is usually assumed when the control electronics are de-energized. A control system for the pilot valve as an input variable has a nominal pressure, a nominal swivel angle, and optionally a nominal output value. An actual pressure at the outlet side of the variable-displacement pump is detected by a pressure sensor. As has been explained above, an actual swivel angle is ascertained by way of the displacement transducer. The recorded actual values are digitally processed in an electronics unit and compared with the predefined nominal values. A minimum value generator then automatically ensures that only the controller assigned to the desired operating point is active. An output signal of the minimum value generator in this instance is a nominal value for a proportional solenoid on the pilot valve. A displacement path of a valve slide of the pilot valve is detected by way of a displacement transducer and relayed to the control system in order for the pilot valve to be controlled. External control electronics are disclosed for the described adjustment of the axial piston variable-displacement machine in document RD 30242/03.10 of the Rexroth company. An electro-hydraulic control system is furthermore disclosed in document RD 92 088/08.04 of the Rexroth company.

A control system for alternatingly controlling a pressure and a conveyed flow is disclosed in EP 1 460 505 A2. A pivotable hydraulic axial piston variable-displacement machine which by way of a drive shaft is connected to a further hydro machine is provided here. A closed-loop control circuit for a drive torque of the variable-displacement machine is furthermore provided. The closed-loop control circuit is supplied an actual drive torque and a nominal drive torque from which a control variable for an actuating installation of the variable-displacement machine is determined. The nominal drive torque in turn is an output variable of a minimum value generator. The latter herein selects an output variable of a pressure controller and of a volumetric flow controller. The volumetric flow of the hydro machine connected to the variable-displacement machine is provided as the actual volumetric flow herein. A high pressure of this hydro machine is furthermore provided as the actual pressure.

A hydro machine with a swivel angle sensor and a pressure sensor is furthermore disclosed in each of documents EP 2 851 565 B 1, U.S. Pat. Nos. 4,801,247, 5,182,908, EP 0 349 092 B 1, U.S. Pat. Nos. 5,267,441, 5,967,756, 5,170,625. The pressure, the volumetric flow, and the output can be controlled.

SUMMARY

In contrast, the disclosure is based on the object of achieving a hydraulic pressurizing medium supply assembly which in terms of devices is designed in a simple and cost-effective manner and nevertheless can reliably and dynamically control and/or limit substantial control variables of an adjustable hydro machine and parameters. A simple method for the pressurizing medium supply assembly is furthermore to be provided.

According to the disclosure, a hydraulic pressurizing medium supply assembly for an open hydraulic circuit, in particular for a mobile work machine, is provided. The pressurizing medium supply assembly can have a hydro machine and an adjusting mechanism. The adjusting mechanism preferably serves for adjusting a delivery volume of the hydro machine. To this end, an actuating cylinder having a set piston is provided. The adjusting mechanism furthermore has a pilot valve which is electrically actuatable in a proportional manner. An inflow to and/or an outflow from a control chamber of the actuating cylinder that is delimited by the set piston can be controlled by way of said pilot valve, in order for the set piston for actuation to be impinged with pressurizing medium. The pressurizing medium supply assembly furthermore preferably has an electronic control. The latter as input variables furthermore preferably has at least a nominal outlet pressure of the hydro machine. Alternatively or additionally, a nominal delivery volume of the hydro machine can be provided as an input variable for the control. It is conceivable for a nominal variable/nominal variables to be established or alternatively to be designed so as to be adjustable such that said nominal variables can be adapted to meet requirements during the operation, for example. A control variable for the pilot valve is preferably provided as an output variable of the control. The control furthermore can have a first closed-loop control circuit for an actual outlet pressure of the hydro machine. Said outlet pressure is preferably detected between a high-pressure connector of the hydro machine and a main control valve for consumers. Alternatively or additionally, the first closed-loop control circuit can be provided for an actual delivery volume of the hydro machine. If the hydro machine is an axial piston machine having an adjustable swivel cradle or swash plate for setting a delivery volume, for example the actual delivery volume can then be detected by way of a corresponding means, for example by way of a swivel angle sensor such as, for example, a displacement transducer for the set piston. As an alternative to the displacement transducer, a swivel angle of the swash plate on the pivot axle can also be detected by way of a Hall sensor. In other words, a measuring means for detecting the displacement position or of the displaced volume is provided. It would also be conceivable for the swivel angle to be determined by way of a torque of the drive shaft and by measuring pressure. A second closed-loop control circuit which can be provided for a delivery-volume adjustment rate preferably underlies the first closed-loop control circuit. An actual delivery-volume adjustment rate, in particular derived from the actual delivery volume, of the hydro machine is preferably provided as an input variable for the second closed-loop control circuit. If the actual delivery-volume adjustment rate is determined by way of the actual delivery volume, the actual delivery volume detected can advantageously be used for the first closed-loop control circuit as well as for the second closed-loop control circuit, this rendering a separate detection of the actual delivery-volume adjustment rate unnecessary. An output variable of the second closed-loop control circuit is preferably the control variable for the pilot valve. A control value in the form of a delivery-volume adjustment rate from the first closed-loop control circuit can advantageously be supplied to the second closed-loop control circuit. The control value from the first closed-loop control circuit can in this instance be a nominal variable for the second closed-loop control circuit.

This solution has the advantage that an electronically actuatable hydro machine which for mobile applications in the open circuit has a simple pump adjusting mechanism without a hydro-mechanical feedback. As opposed to the prior art, it is not necessary for a position of the set piston of the pilot valve to be detected, on account of which corresponding means can be dispensed with, and on account of which costs and complexity in terms of device technology are reduced. The pressurizing medium supply assembly is thus designed in an extremely simple and cost-effective manner. The dynamic characteristic of the system in controlling the pilot valve is in turn taken into account by considering the actual delivery-volume adjustment rate. The control variable of the pilot valve is thus also a function of the delivery-volume adjustment rate, this leading to a higher quality of control.

In a further design embodiment of the disclosure, the first closed-loop control circuit as input variables preferably has the actual outlet pressure of the hydro machine and/or the actual delivery volume of the hydro machine.

The first closed-loop control circuit of the control can furthermore be configured for an actual torque of the hydro machine. In this instance, a nominal torque and an actual torque are provided as input variables for the control, for example. Alternatively or additionally, it is conceivable for the first closed-loop control circuit of the control to be configured for an actual output while including an actual rotating speed of the hydro machine. It is also conceivable for the actual output or the actual torque to be able to be determined from the actual rotating speed by way of a characteristic line, so as to then control the actual output. A controller, in particular a P-controller, can be provided for controlling the actual torque. Alternatively, it is conceivable for the closed-loop controller to be configured as a PI-controller or as a PID controller.

In a further design embodiment of the disclosure, the first closed-loop control circuit has in each case one control variable for the actual outlet pressure of the hydro machine and/or for the actual delivery volume of the hydro machine and/or for the actual torque of the hydro machine. The control in this instance can provide an alternating control which has a minimum value generator for the emitted control variables of the first closed-loop control circuit. An output variable of the minimum value generator in this instance is preferably the control value in the form of the delivery-volume adjustment rate that is supplied to the second closed-loop control circuit. The minimum value generator ensures that only the controller assigned to the desired operating point is automatically active. For example, the minimum value generator selects the lowest of the supplied control variables and then supplies said lowest control variable as the nominal delivery-volume adjustment rate to the underlying second closed-loop control circuit.

The first closed-loop control circuit preferably has a controller for the delivery volume or the swivel angle (from which the delivery volume can be determined) of the hydro machine. Said controller is preferably a P-controller, for example. Alternatively, said controller can be configured as a PI-controller or as a PID-controller. The closed-loop controller as an input variable can have a nominal swivel angle and an actual swivel angle, or a nominal delivery volume or an actual delivery volume.

A filter, for example in the form of a PT1 element or a higher-grade filter, is preferably provided for the actual swivel angle. Pacification of the signal can take place in a simple manner by way of the filter.

The first closed-loop control circuit preferably has a controller for the actual outlet pressure of the hydro machine. Said controller is supplied the actual outlet pressure, in particular detected by way of a pressure sensor, as an input variable as well as the nominal outlet pressure. A PID-controller is preferably provided as a controller. A P-controller or a PI-controller can alternatively be used. The nominal outlet pressure of the hydro machine is preferably adjustable. In order for the nominal outlet pressure to be determined in particular, an actual load sensing (LS) pressure of the consumers which are provided with a pressurizing medium by way of the pressurizing medium supply assembly is detected. The actual LS pressure is in particular the highest actual load pressure of the consumer. The actual LS pressure is preferably supplied as an input variable to the control, or to the controller for the actual outlet pressure, respectively. In load sensing (LS) control, the highest load pressure is to be reported to the variable-displacement pump, and the variable-displacement pump is to be controlled in such a manner that an actual outlet pressure which is higher than the highest actual load pressure by a specific pressure differential ($\Delta p$) prevails in the pump line. It is thus advantageously provided that the controller for the actual outlet pressure is additionally supplied a nominal differential pressure as an input variable. The nominal outlet pressure can then be calculated by adding the actual LS pressure and the nominal differential pressure and serve as an input variable for the controller. The nominal differential pressure can either be established as a fixed parameter or be adjustable and predefined as a flexible parameter.

It is in particular also conceivable for a plurality of actual LS pressures to be detected and for a maximum value to be generated or prioritizing to take place in the control. This can take place by feedback to a main valve or to a main control valve, for example when a delivery quantity of the hydro machine (pump) is limited and the delivery quantity guided through the main valve can thus be limited, on account of which prioritized hydraulic steering is enabled in the case of a supply deficit, for example. The hydro machine (pump) herein, in addition to LS-pressure guiding, is advantageously set to a minimum quantity in order to ensure steering capability even in the case of erroneous information by a pressure sensor. In other words, the LS pressure by means of which the hydro machine is controlled can be considered as the leading variable. It is additionally conceivable for a minimum quantity to be set as a function of the steering requirement, so that the steering capability is maintained even in the case of erroneous information in terms of the LS pressure.

In a controller for the actual outlet pressure and/or for the actual delivery volume and/or for the actual torque, an I-proportion can be provided such as, for example, in a PID-controller, as is explained above. It can in this case be provided, in particular when using the minimum value generator, that the I-proportion is frozen, or is in particular partially or completely withdrawn, in the case of the controller or the controllers which are inactive and have an I-proportion. If the controller then becomes active, the I-proportion is used in the usual manner and the controller can immediately react. This leads to the I-proportion of the controller/controllers not being resorted to in the case of inactivity. This design embodiment can be referred to as an "anti-windup" design embodiment, which means that the freezing and the resetting of the I-proportion are combined.

One or a plurality of filters having a pressure-dependent filter coefficient can be provided for the controller of the actual outlet pressure. The respective filter is, for example, a variable PT1 filter or a filter of a higher grade. The filter or a respective filter is preferably provided for the actual outlet pressure and/or for the actual LS pressure. The pressure-dependent filter is preferably designed in such a manner that filtering is reduced when the actual outlet pressure of the hydro machine increases, and filtering is conversely increased when the actual outlet pressure of the hydro machine decreases, in order to exert influence on the dynamic characteristic of the controlling.

Alternatively or additionally, one or a plurality of filters, in particular having pressure-dependent filter coefficients, in particular for one or a plurality of input variables, can be used for the controller which is set forth above and below.

Alternatively or additionally, it is conceivable for an asymmetric filter to be provided, in particular for the one or a plurality of input variables, for the controller of the actual outlet pressure and/or for one or a plurality of the controllers set forth above and below. Said asymmetric filter operates as a function of the direction to which the swash plate is pivoted. This means that the filter performance of the filter in the first pivoted direction is different from the filter performance in the second pivoted direction.

In a further design embodiment of the disclosure, an amplification factor (Kp) is provided in particular for the controller for the actual outlet pressure, said amplification factor (Kp) being a function of the actual temperature of the pressurizing medium of the hydro machine, in particular of the pressurizing medium at the outlet side, and/or of the actual rotating speed of the hydro machine and/or of the actual outlet pressure of the hydro machine and/or of a predefined pressure gradient or nominal pressure gradient, in particular for the nominal outlet pressure of the hydro machine. The amplification factor can thus be determined as a function of said variables. The amplification factor at the controller can then be multiplied with the control deviation, wherein the control deviation is, for example, the nominal differential pressure minus the actual differential pressure, and wherein the actual differential pressure is equal to the actual LS pressure minus the actual outlet pressure. It is preferably provided that the lower the actual temperature the smaller the amplification factor, since vibrating of the hydro machine in the cold state of the hydro machine can preferably be prevented or at least minimized on account thereof. In analogous manner, it can conversely apply that the higher the actual temperature the greater the amplification factor. Alternatively or additionally, it can be provided that the lower the actual rotating speed of the hydro machine the greater the amplification factor, since the build-up of pressure is a function of the volumetric flow and thus of the rotating speed of the hydro machine. In an analogous manner, it can conversely apply also here that the higher the actual rotating speed the smaller the amplification factor. Alternatively or additionally, it can be provided that the greater the pressure gradient of the nominal outlet pressure the greater the amplification factor. This is advantageous since the greater the pressure gradient the higher the requirement for deflecting the hydro machine, and the hydro machine thus has to react more rapidly than in the range of a minor signal. Conversely, it in this instance also applies here that the smaller the pressure gradient the smaller the amplification factor. Alternatively or additionally, it can be provided that the higher the actual outlet pressure the greater the amplification factor. This is advantageous since the dynamic characteristic of the travel distance is also higher at a higher actual outlet pressure. The hydro machine can thus be more rapidly pivoted without becoming unstable. The same correlation applies vice versa.

The amplification factor can advantageously be configured as a control parameter dependent on an operating point. For example, it can apply to controlling the pressure and/or to controlling the torque and/or to controlling the swivel angle that the higher the actual outlet pressure the higher the amplification factor, or the amplification factor is increased up to a predetermined actual outlet pressure and is subsequently lowered again at a further increasing actual outlet pressure. In other words, an amplification factor can also be provided in the controllers for the actual outlet pressure and/or for the actual torque, in particular for the actual variables. In other words, adapting the closed-loop control circuit amplifications in particular as a function of pressure can be provided. The control parameters can thus be adapted in the operation of the pressurizing medium supply assembly. Adapting the dynamic characteristics of controlling and/or control stability to meet requirements advantageously takes place during operation.

In a further design embodiment of the disclosure it can be provided that a nominal pressure gradient is provided for the controller of the actual outlet pressure. Said nominal pressure gradient is preferably adaptable and adjustable. The nominal pressure gradient in this instance can influence the nominal outlet pressure, for example. An influence may take place in such a manner, for example, that the higher the nominal pressure gradient the faster the hydro machine is to deflect. The higher the nominal pressure gradient the more rapid the increase in terms of the requirement as the actual gradient, which is why the hydro machine is more rapidly pivotable in order to achieve the nominal pressure gradient. It is conceivable for the nominal pressure gradient to be used as a delimitation for the nominal outlet pressure or as a delimitation for the variation of the nominal outlet pressure.

In a further design embodiment of the disclosure the first closed-loop control circuit preferably has a controller for the actual torque or for the actual output based on the actual torque being multiplied by the actual rotating speed. An actual rotating speed which, in particular by way of a rotating speed sensor, is detected on a drive shaft of the hydro machine, can be provided as an input variable. The actual torque or the absorbed torque of the hydro machine (pump) can then be calculated from the actual rotating speed. The actual torque is calculated from the actual swivel angle multiplied by the actual outlet pressure divided by the hydro-mechanical rate of efficiency. The hydro-mechanical rate of efficiency is a function derived from the actual outlet pressure, from the actual swivel angle, and from the actual rotating speed and can be determined, for example, by way of a characteristic line. A nominal torque can furthermore be provided for the controller. The control variable of the controller at the outlet side is preferably supplied to the minimum value generator. The characteristic line for determining the actual torque is a function, for example, of the actual pressure and/or of the actual swivel angle. In other words, a momentary output can be calculated by way of the controller, in particular when the actual rotating speed is included.

In a further design embodiment of the disclosure, the actual variables for the first closed-loop control circuit and the second closed-loop control circuit, or part of the actual variables, and one or a plurality of derivations thereof, are filtered in order for the signals to be pacified. A PT1 element or a variable PT1 element as already described above is used here, for example.

In a further design embodiment of the disclosure it is conceivable for a delivery-volume adjustment rate target or a maximum delivery-volume adjustment rate for the control to be provided, said delivery-volume adjustment rate target or said maximum delivery-volume adjustment rate being able to be supplied to the second closed-loop control circuit in particular downstream of the minimum value generator. The delivery-volume adjustment rate target is in particular supplied to the control by way of a control element. Said control element as an input variable preferably has the control value from the first closed-loop control circuit, thus the control value emitted by the minimum value generator. The delivery-volume adjustment rate target can be provided as a further input variable. The final nominal delivery-volume adjustment rate for the second closed-loop control circuit can then be provided as the output variable of the control element. The control value of the minimum value generator is in particular delimited by way of the additionally predefined delivery-volume adjustment rate target which is adjustable, for example, in order to influence a control dynamic characteristic of the pressurizing medium supply assembly. The delivery-volume adjustment rate target can be, for example, a positive or negative maximum of the delivery-volume adjustment rate. The higher the final nominal delivery-volume adjustment rate the faster the hydro machine is able to deflect.

The control dynamic characteristic of the pressurizing medium supply assembly can be influenced in a simple manner by way of the adjustable nominal pressure gradient and/or the adjustable delivery-volume adjustment rate target explained above. The control force acting on the pilot valve can thus be a function of the nominal pressure gradient and/or of the delivery-volume adjustment rate target. Said values can be adapted in a variable manner during operation. Adapting the control dynamic characteristic to requirements can thus take place during operation and be a function of the operating point or the working point, for example. The dynamic characteristic of the pump can thus be limited and/or adapted by the value or values. The swivel angle of the hydro machine and/or the delivery-volume adjustment rate can in this instance be controlled in such a manner that the nominal value or the nominal values are not exceeded. In other words, adapting the dynamic characteristic of the pressurizing medium supply assembly by way of the adjustable variables (in particular the nominal pressure gradient and/or in particular the adjustable delivery-volume adjustment rate target) can take place by way of software parameters, a soft or a harsh machine behavior thus being able to be set hereby, for example. The dynamic characteristic is also variable in terms of sub-functions. A sub-function can be adapted using the nominal pressure gradient, and the other sub-function can be adapted using the delivery-volume adjustment rate target. A reduction of vibrations is also enabled by adapting the dynamic characteristic. Furthermore, jolting movements can be avoided. It has been demonstrated that the hydraulic pressurizing medium supply assembly leads to an increase in terms of the rate of efficiency, in particular by way of a decrease in the consumption of control fluid.

A further advantage of the hydraulic pressurizing medium supply assembly is easier integration in comparison to hydro-mechanical controllers since the connection lines or hoses to the hydro-mechanical controller of the variable-displacement pump are dispensed with, for example.

In a further design embodiment of the disclosure, preliminary controlling and/or auto-calibrating of a neutral current for an actuator of the pilot valve can be provided. In other words, a pressure-dependent target of a neutral signal value for the pilot valve may be present. The neutral signal value is, for example, the preliminary control value for the pilot valve in which the delivery-volume adjustment rate is zero. To this end, the actual outlet pressure can be referred to. A neutral current can then be determined therefrom, in particular by way of a characteristics map. Said neutral current is then preferably supplied to the control variable of the control, in particular by addition. The control can be relieved on account of the preliminary control of the neutral current. In other words, auto-calibrating of the neutral current can take place. Said auto-calibrating can be required in order for a stationary state of the hydro machine to be maintained as a function of an actual outlet pressure and/or the viscosity of the pressurizing medium and/or a spring variance and/or a magnet variance of the pilot valve. Compensation of the hardware variance can thus be enabled by way of the auto-calibrating of the neutral current.

A nominal torque gradient for the controller of the actual torque is advantageously provided. Said nominal torque gradient can be configured so as to be adaptable and adjustable, for example. The nominal torque gradient can influence the nominal torque, for example. In this case, the nominal torque gradient is preferably provided as a delimitation for the nominal torque or for limiting the variation of the nominal torque. It is also conceivable for the nominal torque gradient to be controlled as a target. In this case, a nominal torque can be formed based on the nominal torque gradient. A provided filter or preliminary filter can in this instance set a nominal dynamic characteristic.

In a further design embodiment, a superordinate machine control can be provided additionally to the control or the pump control. Said machine control is supplied the actual outlet pressure and/or the actual swivel angle and/or the actual torque and/or the actual delivery volume and/or the actual delivery-volume adjustment rate and/or the gradient of the actual outlet pressure and/or the maximum moment and/or the gradient of the moment variation, for example.

In a further design embodiment of the disclosure it can be provided that a valve slide of the pilot valve is actuated in such a manner that said valve slide temporarily or continually carries out an axial oscillating movement, in particular during the operation of the pressurizing medium supply assembly. The oscillating movement preferably takes place in such a manner that the current switched position of the valve slide is not influenced in practical terms. In other words, adapting and optimizing the hysteresis-reducing measure (dithering) in a pressure-dependent manner takes place with the objective of optimizing the hysteresis of the pilot valve and of not influencing the control dynamic characteristic by counter-compensation by dithering, in particular when the controller output operates out of phase or in phase with the dithering.

In other words, a method which is provided for controlling a swept volume and/or a torque and/or a pressure of a hydrostatic machine is disclosed. Said hydrostatic machine can have an actuator device for setting the swept volume of said hydrostatic machine. The method preferably comprises the following steps:

detecting a predefined nominal torque;

detecting a predefined nominal swept volume;

detecting a predefined nominal pressure;

detecting an actual swept volume or a set swept volume;

detecting an actual pressure or a set pressure;

determining the actual torque or the set torque on the drive shaft of the machine.

Controlling a volumetric flow into the actuator device or out of the actuator device by means of a control valve for setting the swept volume based on a force differential between a control force and a force which engages in the opposite direction on the control valve can be provided as a further step. The control force which engages in the opposite direction on the control valve can be a spring force. The control force can furthermore be an electric force of a solenoid valve. The machine is set as a function of the detected swept volume and/or pressure and/or nominal swept volume and/or nominal pressure and/or nominal torque. The swept volume is preferably set such that the smallest swept volume which leads to the nominal variables being achieved is at all times set.

The hydro machine is preferably non-energized at zero stroke or at maximum stroke, depending on the fail-operation application.

As has been explained at the outset, the volumetric flow of the hydro machine or the variable-displacement pump can be determined from the swivel angle of the swash plate. When the variable-displacement pump is not being driven and pressure is absent in the actuating system, the variable-displacement pump, on account of a spring force of a spring, pivots toward a maximum delivery volume, for example. In contrast, the variable-displacement pump in the driven state of the variable-displacement pump and with a non-energized pilot valve and a closed pump outlet pivots toward a zero-stroke pressure. An equilibrium between the pump pressure at the set piston and the spring force of the spring plus the pump pressure at the counter piston is established at approximately 4 to 8 bar. The initial position is usually assumed when the control electronics are de-energized. Conversely, it would also be conceivable for the variable-displacement pump with a de-energized pilot valve to be pivoted to a maximum delivery volume so as to ensure a pressurized medium supply of a consumer, such as a steering box, for example. A pressure limiting valve is preferably provided in this instance in order for the actual outlet pressure of the hydro machine to be limited. This can take place in that the valve behavior of the pilot valve is inverted, for example. The actuating cylinder connector can thus be connected to the tank connector in the non-energized state at the pilot valve, for example.

BRIEF DESCRIPTION OF THE DRAWINGS

Preferred exemplary embodiments of the disclosure will be explained in more detail hereunder by means of schematic drawings in which.

DETAILED DESCRIPTION

Figure 1:
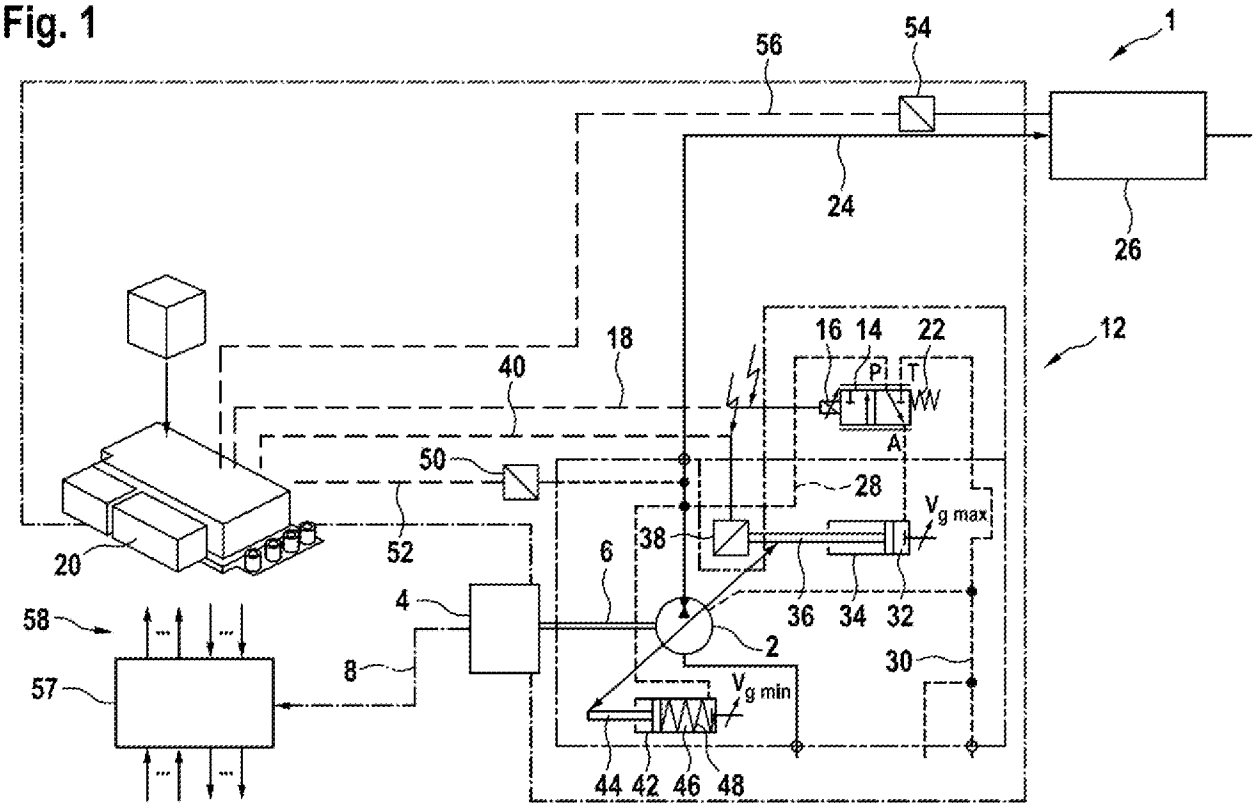
FIG. 1 in a schematic illustration shows a hydraulic pressurizing medium supply assembly according to a first exemplary embodiment.

Shown according to FIG. 1 is a hydraulic pressurizing medium supply assembly 1 which has a hydro machine in the form of an axial piston machine 2. Said axial piston machine 2 has a swivel cradle for adjusting a delivery volume. The axial piston machine 2 can be used as a pump as well as a motor. The axial piston machine 2 is driven by a drive unit 4 which can be, for example, an internal combustion engine such as, for example, a diesel engine, or an electric motor. The axial piston machine 2 is connected to the drive unit 4 by way of a drive shaft 6. A rotating speed 8 of the drive shaft 6 can be detected by way of means not illustrated, for example by way of a rotating speed sensor, and be supplied to a control of the pressurizing medium supply assembly 1. An adjusting mechanism 12 is provided for the axial piston machine 2. Said adjusting mechanism 12 has a pilot valve 14. The valve slide of said pilot valve 14 is electrically actuatable in a proportional manner by way of an actuator 16. To this end, the actuator 16 is supplied a control variable 18 by a control 20. The valve slide of the pilot valve 14 in the direction of an initial position is impinged with a spring force of a valve spring 22. The spring force acts counter to the actuating force of the actuator 16.

The axial piston machine 2 at the outlet side is connected to a pressure line 24 which in turn is connected to a main control valve 26 or a valve block. The supply of pressurizing medium between the axial piston machine 2 and one or a plurality of consumers can be controlled by way of said main control valve 26. A control line 28 which is connected to a pressure connector P of the pilot valve 14 branches off from the pressure line 24. The control line 28 is configured, for example, in a housing of the axial piston machine 2. The pilot valve 14 furthermore has a tank connector T which by way of a tank line 30 is connected to a tank. The pilot valve 14 moreover has an operation connector A which is connected to a control chamber 32 of an actuating cylinder 34. The control chamber 32 herein is delimited by a set piston 36 of the actuating cylinder. A swash plate of the axial piston machine 2 can in this instance be adjusted by way of the set piston 36. A displacement path of the set piston 36 is detected by way of a displacement transducer 38. Alternatively or additionally, a swivel angle of the swivel cradle of the axial piston machine 2 is detected on a pivot axle of the swivel cradle by way of a rotary magnetic sensor. The actual delivery volume or the actual displacement volume of the axial piston machine 2 can in this instance be determined by way of the detected path. The actual delivery volume 40 is then reported to the control 20. The pressure connector P in the initial position of the valve slide of the pilot valve 14 is connected to the operation connector A, and the tank connector T is blocked. When the valve slide is impinged with the actuating force of the actuator 16, the valve slide, proceeding from the initial position thereof, is moved in the direction of switched positions in which the pressure connector P is blocked and the operation connector A is connected to the tank connector T. The set piston 36 in the initial position of the valve slide of the pilot valve 14 is thus impinged with pressurizing medium from the pressure line 24. Furthermore provided in the adjusting mechanism 12 is a cylinder 42. The latter has a set piston 44 which engages on the swash plate of the axial piston machine 2. The set piston 44 delimits a control chamber 46 which is connected to the pressure line 24. The set piston 44 by way of pressurizing medium of the control chamber 46 and by way of the spring force of a spring 48 is impinged in such a manner that said set piston 44 loads the swash plate in the direction of increasing the delivery volume.

Furthermore provided is a pressure sensor 50 by way of which the pressure in the pressure line 24 is detected and reported to the control 20, wherein the pressure is an actual outlet pressure 52. Moreover provided is a pressure sensor 54 which detects the highest actual load pressure (actual LS pressure) 56, the latter being transmitted to the control 20.

A control 57 by way of a CAN interface 58 is connected to the control 20, in particular for transmitting the actual rotating speed to the control 20. It is also conceivable for the actual rotating speed 8 to be supplied directly to the control 20.

The position of the swash plate of the axial piston machine 2 in the use of the pressurizing medium supply assembly 1 is controlled by way of the pilot valve 14 and the set piston 36. A conveyed volumetric flow of the axial piston machine 2 is proportional to the position of the swash plate. The adjusting piston 44 pre-loaded by the spring 48, or the counter piston, is at all times impinged by the actual outlet pressure or the pump pressure. In a non-rotating axial piston machine 2 and an adjusting mechanism 12 without pressure the swash plate by the spring 48 is kept in a position of +100 percent. In a driven axial piston machine 2 and a non-energized actuator 16 of the pilot valve 14, the swash plate pivots to a zero-stroke pressure, since the set piston 36 is impinged with pressurizing medium of the pressure line 24. An equilibrium between an actual outlet pressure at the set piston 36 and the spring force of the spring 48 is established at a predetermined pressure or pressure range, for example between 8 to 12 bar. Said zero-stroke operation is assumed, for example, in the event of de-energized electronics or a de-energized control 20. The actuation of the pilot valve 14 takes place by way of the control 20, the latter being, for example, preferably digital electronics, alternatively analog electronics. The control 20 processes the required control signals, as is explained in more detail hereunder.

Figure 2:
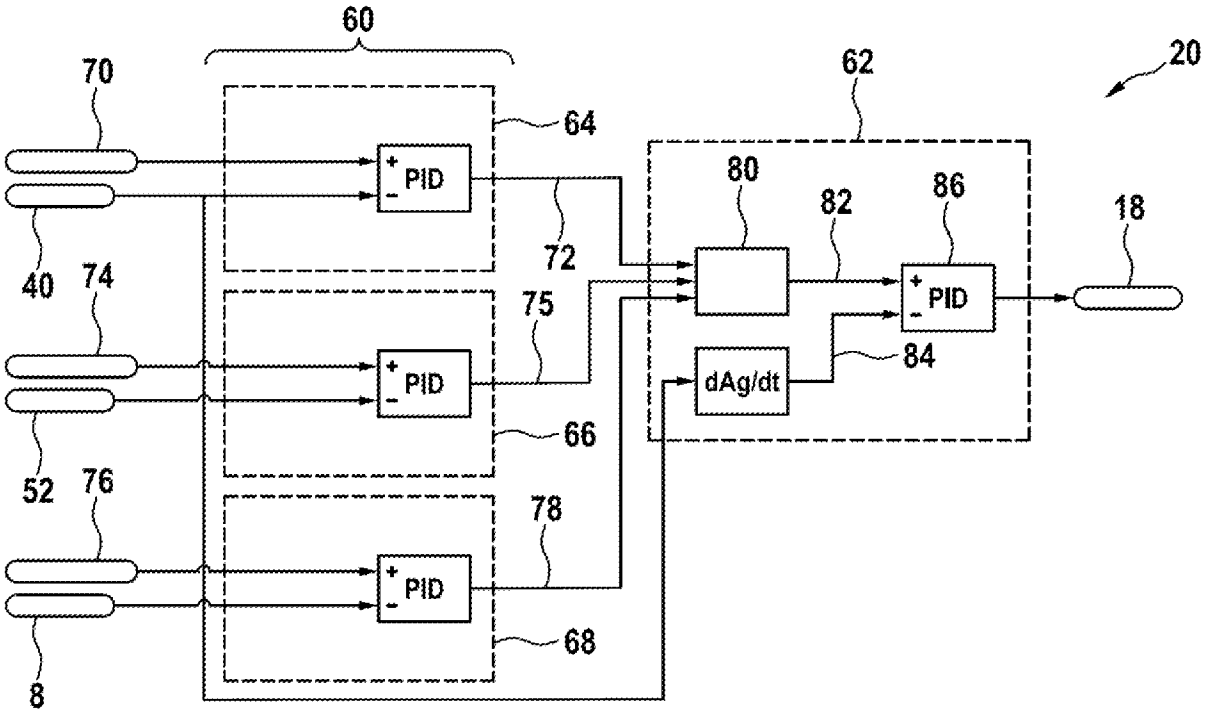
FIG. 2 in a schematic illustration shows a control for the pressurizing medium supply assembly from FIG. 1.

FIG. 2 schematically shows a functioning mode of the control 20. The latter has a first closed-loop control circuit 60 and a second closed-loop control circuit 62. The first closed-loop control circuit 60 has a controller 64 for a swivel angle of the swash plate of the axial piston machine 2 from FIG. 1, a controller 66 for the outlet pressure of the axial piston machine 2, and a controller 68 for a torque of the axial piston machine 2. The controller 64 as input variables has a nominal delivery volume 70 and the actual delivery volume 40. A control variable 72 is provided as an output variable. The controller 66 as input variables has a nominal outlet pressure 74 and the actual outlet pressure 52. A control variable 75 is provided as an output variable. The controller 68 as input variables has an actual torque 76 or a nominal torque. The actual torque which in turn is able to be determined by means of a characteristics map by way of the actual rotating speed 8 is provided as a further input variable. A control variable 78 is provided as an output variable for the controller 68. In the respective controllers 64 to 68, the input variables are in each case supplied to a control element in the form of a PID controller.

The control variables 72, 75 and 78 are supplied to a minimum value generator 80. The latter ensures that only the controller 72, 75 or 78 assigned to the desired operating point is automatically active. Either the outlet pressure, the torque, or the delivery volume herein is precisely controlled, wherein the respective two other variables are below a predefined nominal value. An output signal of the minimum value generator 80 in this instance is a nominal value in the form of a delivery-volume adjustment rate or a nominal delivery-volume adjustment rate 82.

The latter in this instance is an input variable for the second underlying closed-loop control circuit 62. The derivation of the actual delivery volume 40 is a further input variable of the second closed-loop control circuit 62, said further input variables in this instance being an actual delivery-volume adjustment rate 84. The input variables 82 and 84 for the second closed-loop control circuit 62 are then supplied to a control element in the form of a PID element 86. The latter then emits the control variable 18 for the pilot valve 14 from FIG. 1.

Figure 3:
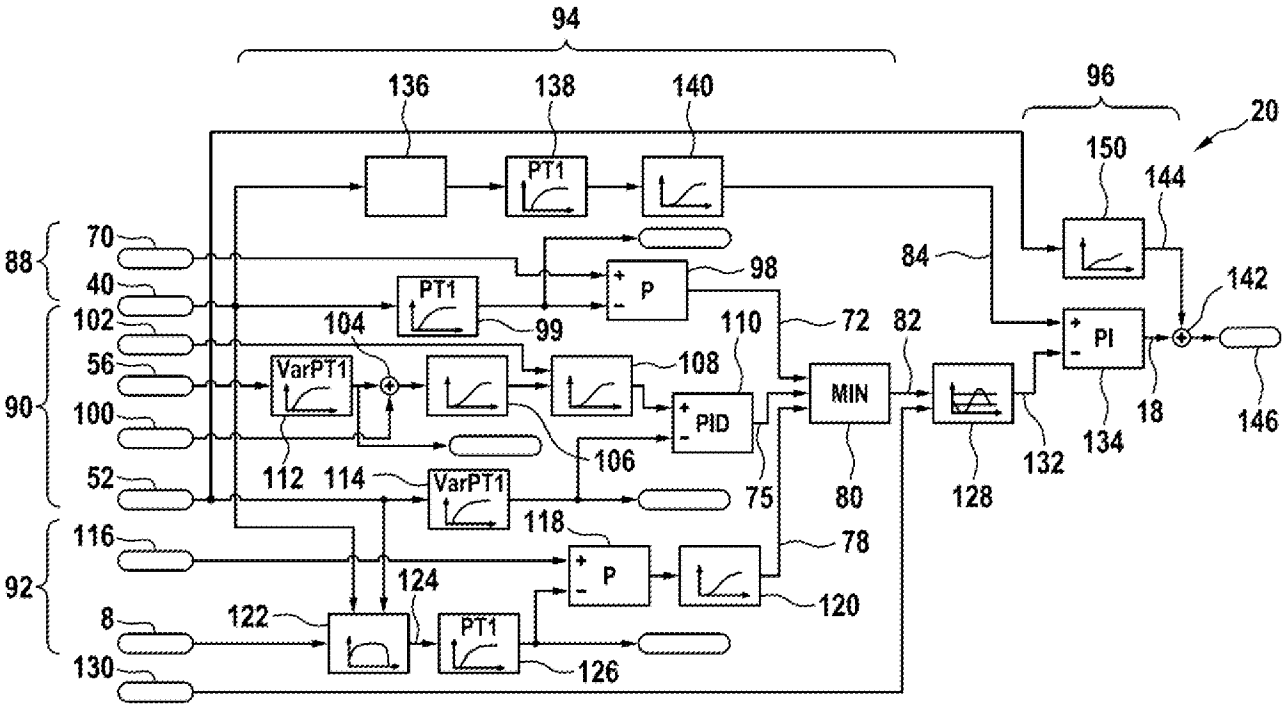
FIG. 3 in a schematic illustration shows a control for the pressurizing medium supply assembly from FIG. 1, according to a further exemplary embodiment.

According to FIG. 3, a further embodiment for the control 20 from FIG. 1 is shown. Said further embodiment has a controller 88 for the delivery volume of the axial piston machine 2, cf also FIG. 1. Furthermore provided are a controller 90 for the outlet pressure of the axial piston machine 2 and a controller 92 for the torque of the axial piston machine 2. This forms part of a first closed-loop control circuit 94. Furthermore provided so as to underlie the first closed-loop control circuit is a second closed-loop control circuit 96 for the delivery-volume adjustment rate of the axial piston machine 2.

The controller 88 has a control element 98 in the form of a P-element. The nominal delivery volume 70 and the actual delivery volume 40 are provided as input variables. The actual delivery volume 40 is supplied to the control element 98 by way of a filter in the form of a PT1 filter. The control variable 72 is provided as the output variable at the output side of the controller 88, said control variable 72 being supplied to the minimum value generator 80.

The controller 90 as input variables has the actual outlet pressure 52, the actual LS pressure 56, a nominal pressure differential 100 and a nominal pressure gradient 102. The actual LS pressure 56 and the nominal pressure differential 100 by way of a summing element 104 are linked so as to form a nominal outlet pressure. The nominal outlet pressure is then supplied to a control element 106 in the form of an inverted PT1 element which estimates a predicted signal profile. The nominal outlet pressure is then furthermore supplied to a control element 108 which has the nominal pressure gradient 102 as a further input variable. The nominal pressure gradient 102 then predefines the maximum potential gradient which is to be provided. The nominal outlet pressure by way of the control element 108 is then influenced by the predefined nominal pressure gradient 102 in such a manner that the dynamic characteristic of the pressurizing medium supply assembly 1 from FIG. 1 can be controlled by the nominal pressure gradient 102. For example, the influence can be such that the higher the nominal pressure gradient 102 the more rapidly the swash plate of the axial piston machine 2 is able to be adjusted. It conversely applies in this instance that the smaller the nominal pressure gradient the slower the swash plate of the axial piston machine 2 is adjusted. After the control element 108, the nominal outlet pressure is then supplied to a control element 110 in the form of a PID element. The actual outlet pressure 52 is then provided as a further input variable for the control element 110. The control variable 75 which is supplied to the minimum value generator 80 results as the output variable of the control element 110.

The actual LS pressure 56 of the controller 90 prior to the summing element 104 is supplied to a filter 112 which is a variable PT1 filter. The same applies to the actual outlet pressure which prior to the control element 110 is likewise supplied to a filter 114 in the form of a variable PT1 filter. The filters 112 and 114 have variable, in particular pressure-dependent, filter coefficients, as is explained in more detail above.

The controller 92 as input variables has the actual rotating speed 8, the actual delivery volume 40, the actual outlet pressure 52, and a nominal torque 116. The input variables are supplied to a control element 118 in the form of a P-element. The control variable 78 which is supplied to the minimum value generator 80 is provided as an output variable for the control element 118. A control element 120 which, as in the case of the control element 106, is an inverted PT1 filter, is provided for the control variable 78 after the control element 118. Furthermore, the actual rotating speed, the actual delivery volume 40, and the actual outlet pressure 8, prior to being supplied to the control element 118, are supplied to a control element 122. The latter serves for calculating an actual torque 124 based on the actual rotating speed 8, on the actual delivery volume 40, and the actual outlet pressure 8. The calculation is performed by means of a characteristics map of the control element 122. The characteristics map is a function of the actual outlet pressure 52 which is supplied to the control element 122. The actual delivery volume 40 is furthermore supplied to the control element 122. The characteristics map in this instance can alternatively or additionally be a function of the actual delivery volume 40. In other words, the actual torque 124 is formed from the actual rotating speed 8 and from the actual outlet pressure 52 and/or from the actual delivery volume 40. The actual torque 124, prior to reaching the control element 118, is then subsequently supplied to a filter 126 in the form of a PT1 element.

Furthermore, the actual delivery volume 40, prior to being supplied to the control element 98, is supplied to a filter 99 in the form of a PT1 element.

The minimum value generator 80 from the control variables 72, 75 and 78 forms the nominal delivery-volume adjustment rate 82. The latter is supplied to a control element 128. The dynamic characteristic of the pressurizing medium supply assembly 1 can be influenced by said control element 128. To this end, a delivery-volume adjustment rate target 130, which is adjustable, is provided as a further input variable for the control element 128. For example, the nominal delivery-volume adjustment rate 82 which is emitted from the minimum value generator 80 can be limited and/or influenced in such a manner by way of the delivery-volume adjustment rate target 130 that the greater the variable 130 the faster the swash plate of the axial piston machine 2 can be pivoted and vice versa. The dynamic characteristic of the pressurizing medium supply assembly 1 can thus be influenced by adjusting the delivery-volume adjustment rate target 130 and/or by adjusting the nominal pressure gradient 102. On account thereof, the pressurizing medium supply assembly 1 can be adapted in a simple and cost-effective manner to different work machines and/or to different application conditions and/or to different specific applications, for example.

After the control element 128, the final nominal delivery-volume adjustment rate 132 as an input variable is supplied to the second closed-loop control circuit 96. The latter has a control element 134 in the form of a PI-element. The actual delivery-volume adjustment rate 84 is provided as a further input variable for the control element 134. Said actual delivery-volume adjustment rate 84 is based on the actual delivery volume 40 which is derived in a control element 136. Thereafter, the derivation, thus the actual delivery-volume adjustment rate, is supplied to a filter 138 in the form of a PT1 filter. Prior to the actual variable 84 being supplied to the control element 134, a control element 140 in the form of an inverted PT1 filter is subsequently provided. The control element 134 of the second closed-loop control circuit 96 has the control variable 18 as the output variable for the pilot valve 14 from FIG. 1. Said control variable 18 is supplied to a summing element 142. A preliminary control value 144 is provided as a further input variable for the summing element 142. Said preliminary control value 144 is an output variable of a control element 150 which has the actual outlet pressure 52 as the input variable. The preliminary control value 144 is then determined based on the actual outlet pressure 52. The summing element 142 then links the control variable 18 and the preliminary control value 144, a neutral current of the pilot valve being pre-controlled therewith. A pressure-dependent target of a neutral signal value for the pilot valve 14 from FIG. 1 is thus established. This has the advantage that the control 20 is relieved in terms of said control task. A final control variable 146 for the pilot valve 14 is then provided as an output variable of the summing element 142.

It is conceivable that a control element which is not illustrated and which has the control variable 146 as the input variable is disposed downstream of the summing element 142. Said control variable 146 is superimposed with a low-frequency signal by the control element, so that the valve slide of the pilot valve 14 is continually in axial oscillating movement so as to avoid seizing of the valve slide. The final control variable for the pilot valve 14 is in this instance provided as the output variable of the control element. The superimposition by the low-frequency signal can be referred to as "dithering". The object of dithering is to reduce the hysteresis of the pilot valve 14 in that a minor movement of the valve slide is maintained. The movement herein must not become excessively large so as to avoid effects on the system (for example, the pilot valve 14 oscillates excessively such that said oscillation is reflected in the swivel angle or the pressure). The dithering (frequency and amplitude) is optimized in such a manner that the hysteresis is minimized and the system is not excited. The smaller the frequency and the larger the amplitude the better the valve slide can be kept in movement. However, a small frequency leads to a large periodic duration of the superimposed "sinus signal". The problem that said period may run so as to be specifically counter to the nominal signal is created on account thereof. A delayed reaction is obtained when the superimposed dithering runs in the direction other than the nominal signal, which can be disadvantageous in terms of controlling the pump. There is however the possibility for the dithering frequency to be increased and/or the amplitude to be reduced at comparatively high pressures, since better lubrication takes place by virtue of the pressure and the hysteresis of the pilot valve 14 decreases. The influence of out-of-phase dithering is also reduced on account thereof, and the control dynamic characteristic is enhanced.

Figure 4:
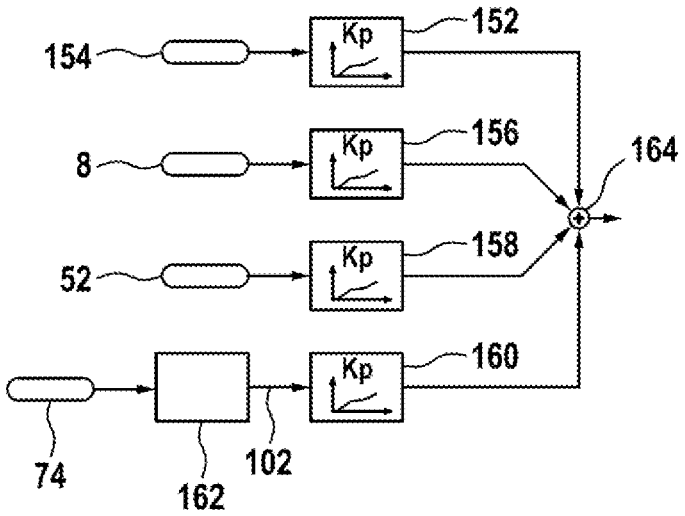
FIGS. 4 and 5 in a schematic illustration show in each case a determination of amplification factors of a controller according to one exemplary embodiment.

FIG. 4 schematically shows a control parameter for the control 20 which is dependent on the operating point. Said control parameter in an exemplary manner is an amplification factor Kp of the controller 90 for the outlet pressure of the axial piston machine 2. The amplification factor Kp is supplied to the control 20 by way of the control element 110, for example. According to FIG. 4, the amplification factor Kp as a function of a temperature 154 of a pressurizing medium of the pressurizing medium supply assembly 1 can be calculated by way of a control element 152. The temperature is detected from the pressurizing medium in the pressure line 24 by way of a sensor, for example. The amplification factor Kp in this instance is determined by way of a characteristics map, for example. Alternatively or additionally, the amplification factor by way of a control element 156 can be a function of the actual rotating speed 8. The amplification factor Kp herein is likewise determined by way of a characteristics map. Alternatively or additionally, a control element 158 by way of which the amplification factor Kp is able to be determined by way of the actual outlet pressure 52 is provided, wherein this can likewise take place by way of a characteristics map. Alternatively or additionally, the amplification factor Kp based on the nominal pressure gradient 102 can furthermore be determined by way of a control element 160. The nominal pressure gradient 102 herein can be derived from the nominal outlet pressure 74 by way of a control element 162. If the amplification factor Kp is determined by way of a plurality of control elements 152, 156, 158, 160, said amplification factor Kp can be linked by way of a respective control element 164 at the outlet side and then be finally emitted as an output variable of the control element 164.

Figure 5:
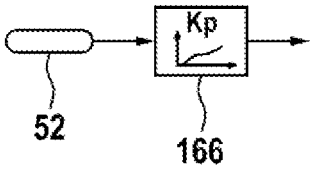

According to FIG. 5, the amplification factor Kp, alternatively or additionally to the control elements 152, 156, 158, 160 shown in FIG. 4, can be determined by way of the actual outlet pressure 52. To this end, a control element 166 in which the amplification factor Kp in this instance based on the actual outlet pressure 52 is determined by way of a characteristics map. In this case, the amplification factor Kp increases the higher the actual outlet pressure. The amplification factor Kp, alternatively or additionally to the controller 90, can also be used for the controller 88 and/or 92.

It is also conceivable that a temporal adaptation of the running times of at least one signal, or of part of the signals, or of all signals of the closed-loop control circuits 94 and 96 from FIG. 3 is provided, wherein a phasing of the signal or signals is in particular adaptable. This can take place by way of the control element 106 and/or 120, for example.

The preliminary control value 144 in the control element 150 can preferably be determined based on a model while taking into consideration flow forces at the pilot valve 14 and/or a magnet characteristic of the actuator 16 and/or of a control edge characteristic of the valve slide of the pilot valve 14 and/or a spring stiffness of the valve spring 22.

Figure 6A:
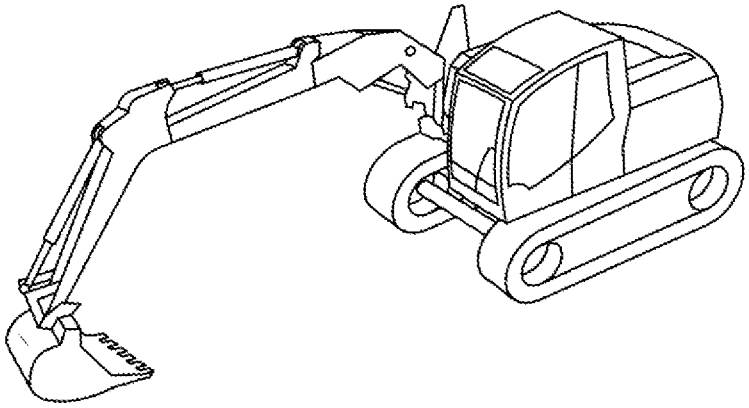
FIGS. 6*a* and 6*b* show a crawler excavator, and in a schematic illustration a pressurizing medium supply assembly for a crawler excavator.
Figure 6B:
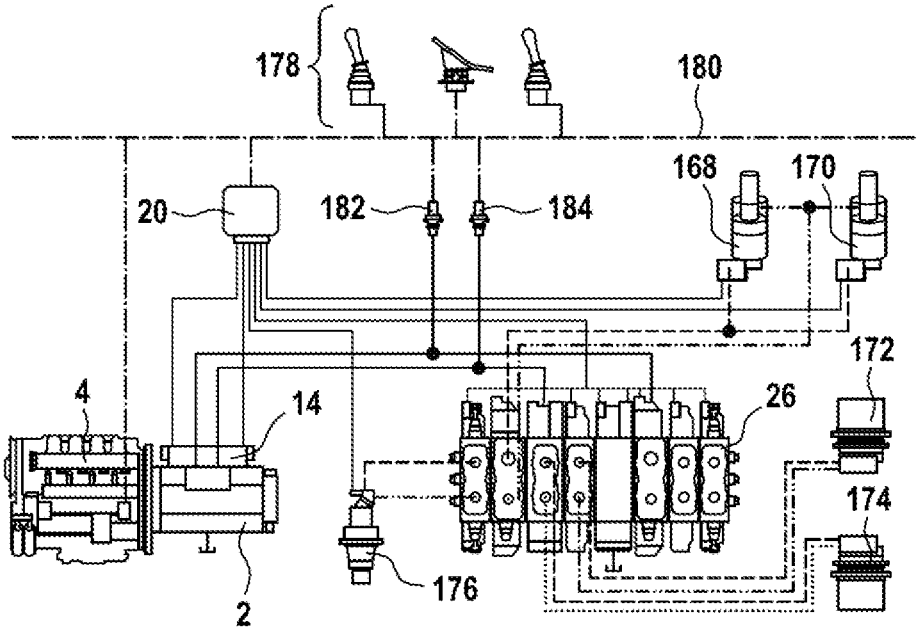

Shown according to FIG. 6*a* is a crawler excavator which according to FIG. 6*b* has a pressurizing medium supply assembly, see FIG. 1. Said crawler excavator has the axial piston machine 2 which is driven by the drive unit 4 in the form of a diesel engine. The supply of pressurizing medium to the hydro cylinders 168 and 170, to the hydro machines 172, 174 for moving the crawling excavator, and to a hydraulic auxiliary drive 176 is controlled by way of the main control valve 26. The crawler excavator herein has various input means 178 for an operator, said input means 178 being connected to a CAN bus 180. Pressure sensors 182, 184 are furthermore connected to the CAN bus 180. Said pressure sensors 182, 184 detect the actual outlet pressure of the axial piston machine 2. A safety valve is in each case provided at the inlet side of the hydro cylinders 168, 170, said safety valves safeguarding the hydro cylinders 168, 170 in the event of a breakage of an inlet line. Required input variables are detected by way of the control 20, as explained above, and the pilot valve 14 is in particular controlled by way of said control 20. Moreover, the main control valve 26 is controlled as a function of the signals of the input means 178 detected by way of the CAN bus 180.

Figure 7A:
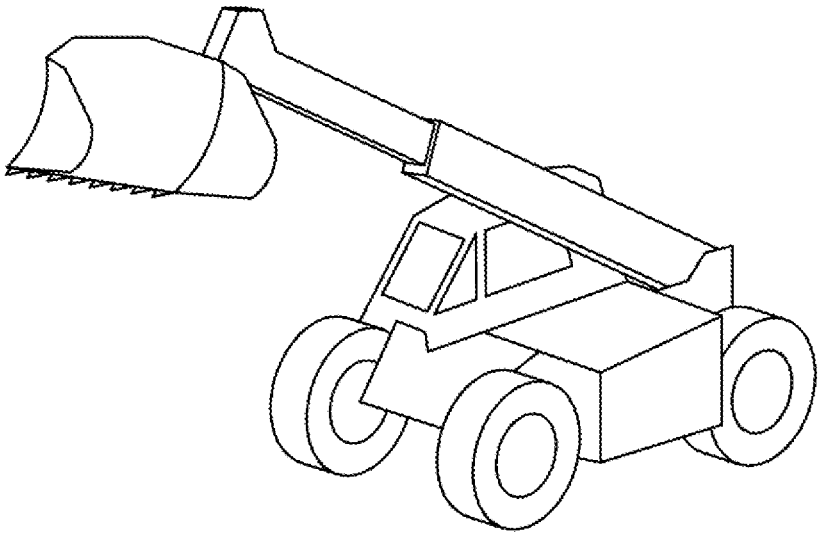
FIGS. 7*a* and 7*b* show a telehoist load lugger, and in a schematic illustration a pressurizing medium supply assembly for a telehoist load lugger.
Figure 7B:
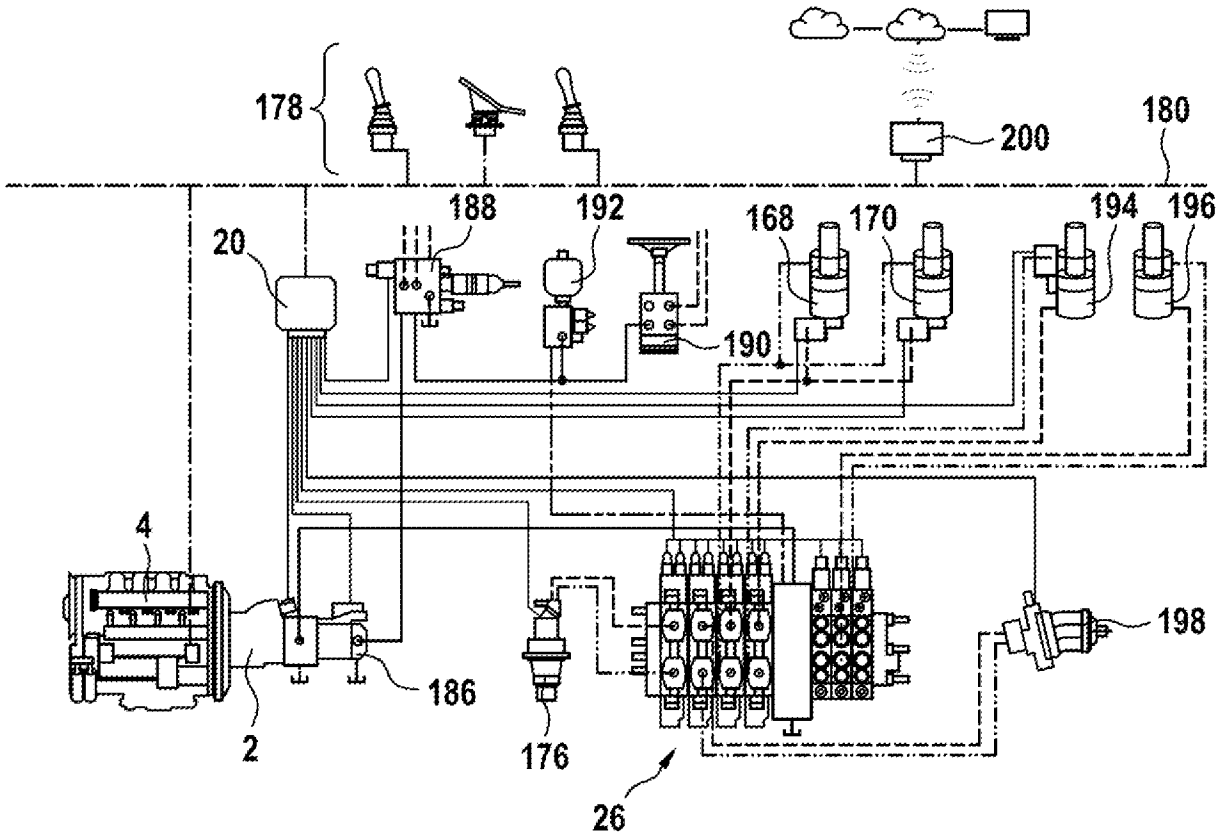

FIG. 7*a* shows a telehandler having a the pressurizing medium supply assembly according to FIG. 7*b*. Said telehandler has two axial piston machines 2 and 186 which are driven by the drive unit 4 in the form of a diesel engine by way of a common drive shaft. Pilot valves of the axial piston machine 2, 186 are controlled by way of the control 20, as has been explained above. The axial piston machine 186 serves for supplying pressurizing medium to a wheel brake 188, to a steering system 190, and to a pilot fluid supply 192. The pilot fluid supply 192 is provided for the main control valve 26, or the main control valve block, respectively. The supply of pressurizing medium to hydro cylinders 168, 170, 194, 196 is controlled by way of said main control valve block. A hydro machine 198 used herein and the hydraulic auxiliary motor 176 are furthermore controlled by way of the main control valve 26. Input means 178 which by way of the CAN bus 180 are connected to the control 20, for example, are provided according to the exemplary embodiment in FIGS. 6*a* and 6*b*. A communication installation 200 is furthermore provided in order to communicate with a server and/or with a computer in a wireless manner, for example by radio or WiFi. For example, input variables for the control 20 can be adapted and/or a software can be upgraded or updated by way of the communication installation 200. Moreover, it is possible for data which includes information pertaining to a state of the pressurizing medium supply assembly 1 to be sent by way of the communication installation 200.

Figure 8A:
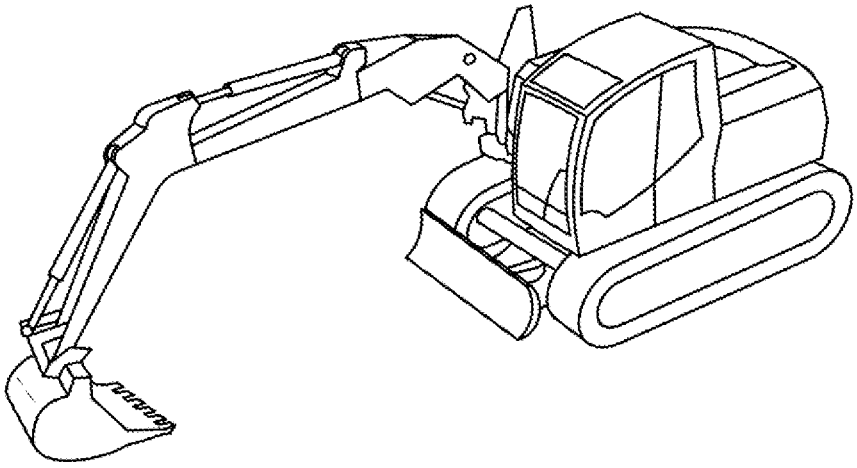
FIGS. 8*a* and 8*b* show a compact excavator, and in a schematic illustration a pressurizing medium supply assembly for a compact excavator.
Figure 8B:
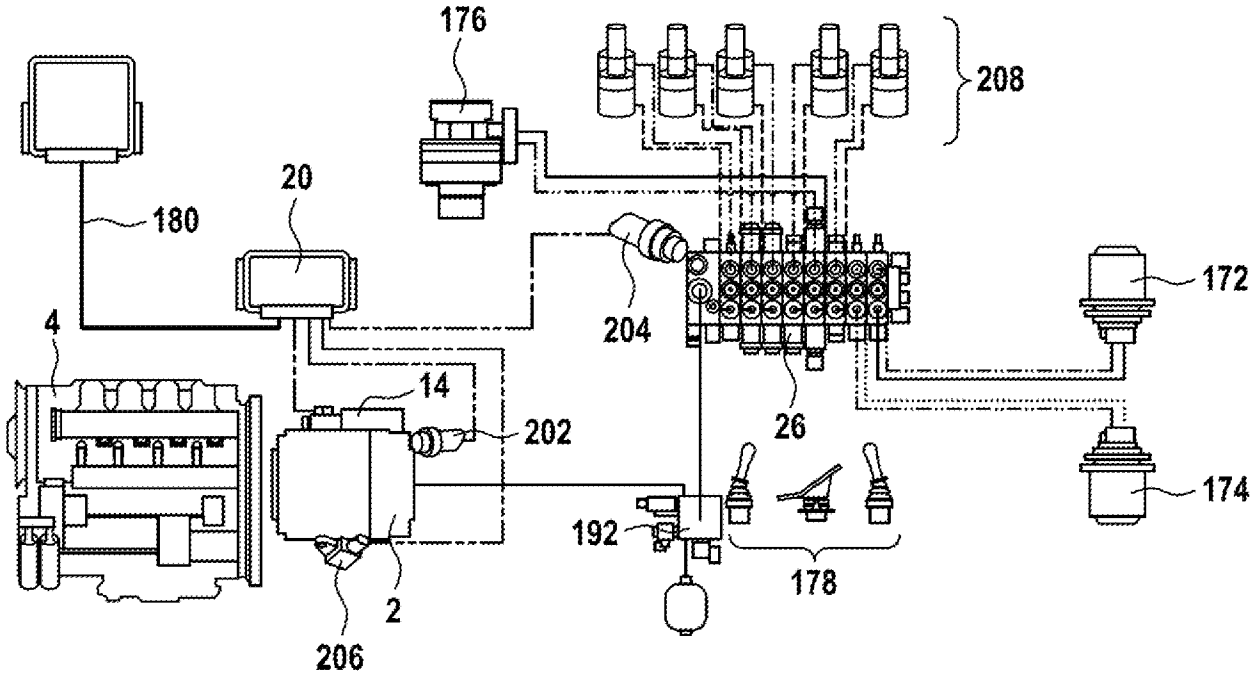

According to FIG. 8*a*, a compact excavator having a pressurizing medium supply assembly according to FIG. 8*b* is shown. The axial piston machine 2 which is driven by the drive unit 4 in the form of a diesel engine can be seen herein. Furthermore shown is the control 20 which is connected to a pressure sensor 202, for example, which detects the actual outlet pressure of the axial piston machine 2. The control 20 is moreover connected to a pressure sensor 204 which by way of the main control valve 26, or the main control block, respectively, detects the highest load pressure. The control 20 is furthermore connected to a displacement transducer 206 for the swivel angle of the swash plate of the axial piston machine 2. The pilot valve 14 is moreover connected to the control 20. Five hydro cylinders 208 are connected to the main control valve 26. Furthermore connected are the hydro machines 172, 174, and the hydraulic auxiliary motor 176. The pilot fluid supply 192 can optionally be provided. Input means 178 can hydraulically control the main control valve 26, for example, or be connected to the pressurizing medium supply assembly by way of the CAN bus 180.

Figure 9A:
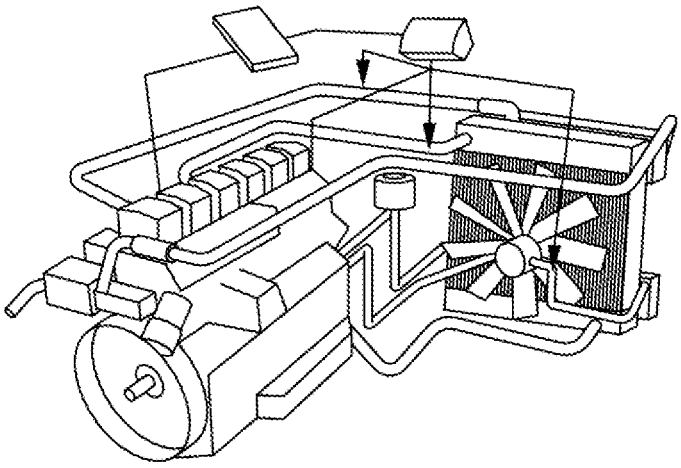
FIGS. 9*a* and 9*b* show a cooling/ventilating system, and in a schematic illustration a pressurizing medium supply assembly for a cooling/ventilating system.
Figure 9B:
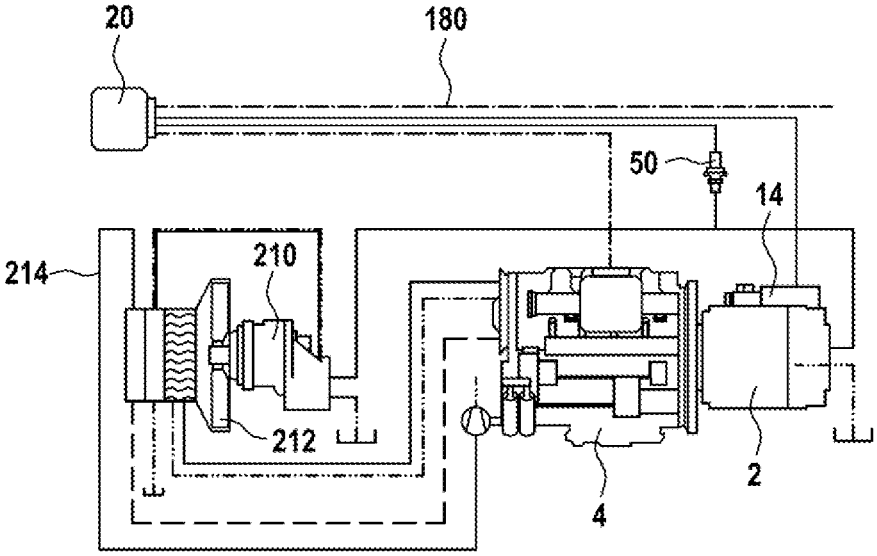

The application potential of the pressurizing medium supply assembly 1 from FIG. 1 for a ventilation system is shown according to FIGS. 9*a* and 9*b*. According to FIG. 9*a*, the axial piston machine 2 which is driven by way of the drive unit 4, for example in the form of a diesel engine, is provided. The actual outlet pressure of the axial piston machine 2 is detected by way of the pressure sensor 50. A fan motor in the form of a hydro machine 210 is driven by way of the axial piston machine 2. Said hydro machine 210 in turn drives fan blades 212 in order for an air stream to be generated. Coolant of a cooling circuit is then cooled by way of the air stream. The pilot valve 14 can be controlled by way of the control 20. One or a plurality of temperatures detected by way of sensors can be supplied to the control 20 by way of the CAN bus 180, for example. The temperature can be, for example, a temperature of the coolant in a coolant line 214 and/or a temperature of the drive unit 4 and/or a temperature of the pressurizing medium. It is also conceivable for further input variables to be supplied to the control 20, as has been explained above.

What is claimed is:

1. A hydraulic pressurizing medium supply assembly for an open hydraulic circuit, comprising:

a hydro machine;

an adjusting mechanism including (i) an actuating cylinder having a set piston configured to adjust a delivery volume of the hydro machine, and (ii) a pilot valve electrically actuatable in a proportional manner, wherein an inflow to and/or an outflow from a control chamber of the actuating cylinder that is limited by the set piston is configured for control via the pilot valve in order for an actuation of the set piston to be impinged with pressurizing medium; and an electronic control which, as input variables, has at least a nominal outlet pressure of the hydro machine and/or a nominal delivery volume or a nominal swivel angle of the hydro machine, and which, as an output variable, has a control variable for the pilot valve, wherein the electronic control has a first closed-loop control circuit for an actual outlet pressure of the hydro machine and/or for an actual delivery volume or an actual swivel angle of the hydro machine, wherein the electronic control, so as to underlie the first closed-loop control circuit, has a second closed-loop control circuit for a delivery-volume adjustment rate or a swivel-angle adjustment rate of the hydro machine, wherein the second closed-loop control circuit, as an input variable, having an actual delivery-volume adjustment rate or an actual swivel-angle adjustment rate of the hydro machine, and, as an output variable, having the control variable for the pilot valve, and wherein the second closed-loop control circuit is supplied a control value from the first closed-loop control circuit in the form of a nominal delivery-volume adjustment rate or a nominal swivel-angle adjustment rate.

2. The hydraulic pressurizing medium supply assembly according to claim 1, wherein:

the first closed-loop control circuit is configured for an actual torque of the hydro machine, and a nominal torque and the actual torque are included as the input variables for the electronic control.

3. The hydraulic pressurizing medium supply assembly according to claim 2, wherein:

the first closed-loop control circuit emits in each case one control variable for the actual outlet pressure of the hydro machine and/or for the actual delivery volume or the actual swivel angle of the hydro machine and/or for the actual torque of the hydro machine, and the electronic control has an alternating control including a minimum value generator for the emitted control variables.

4. The hydraulic pressurizing medium supply assembly according to claim 3, wherein:

the first closed-loop control circuit for the actual outlet pressure of the hydro machine and/or for the actual delivery volume or the actual swivel angle of the hydro machine and/or for the actual torque of the hydro machine includes a further controller having an I-proportion, and the I-proportion, in a case of an inactive controller having the I-proportion or inactive controllers having the I-proportion, is frozen or partially or completely reduced.

5. The hydraulic pressurizing medium supply assembly according to claim 1, wherein a nominal pressure gradient is included as one of the input variables for controlling the actual outlet pressure in the first closed-loop control circuit.

6. The hydraulic pressurizing medium supply assembly according to claim 5, wherein the nominal pressure gradient is adjustable for adapting control dynamics of the hydraulic pressurizing medium supply assembly.

7. The hydraulic pressurizing medium supply assembly according to claim 5, wherein the nominal pressure gradient limits variation of the nominal outlet pressure.

8. The hydraulic pressurizing medium supply assembly according to claim 1, wherein a delivery-volume adjustment rate target or a swivel-angle adjustment rate target is included as one of the input variables for the electronic control that is adjustable for adapting control dynamics of the hydraulic pressurizing medium supply assembly.

9. The hydraulic pressurizing medium supply assembly according to claim 8, wherein:

the delivery-volume adjustment rate target or the swivel-angle adjustment rate is supplied to a control element which, as a further input variable, has the control value of the first closed-loop control circuit in the form of the nominal delivery-volume adjustment rate or the nominal swivel-angle adjustment rate, and the control element, as an output variable, emits a final nominal delivery-volume adjustment rate for the second closed-loop control circuit that is limited by the delivery-volume adjustment rate target.

10. The hydraulic pressurizing medium supply assembly according to claim 1, wherein:

a highest actual load pressure of consumers which are supplied by the hydraulic pressurizing medium supply assembly is detected as an actual load sensing pressure and is supplied as one of the input variables to the electronic control, a nominal pressure differential is included as one of the input variables for the electronic control, wherein a nominal pressure for the electronic control which is included as one of the input variables for the first closed-loop control circuit is determined from the actual load sensing pressure and the nominal pressure differential, and/or wherein actual load sensing pressures of part of the consumers or of all consumers are detected, and wherein generating a maximum value or prioritizing the actual load sensing pressures takes place in the electronic control.

11. The hydraulic pressurizing medium supply assembly according to claim 1, wherein a filter is included for at least one of the input variables, or for part of the input variables, or for all input variables of the electronic control.

12. The hydraulic pressurizing medium supply assembly according to claim 1, wherein:

a, or a respective, amplification factor for the first closed-loop control circuit is included for controlling the actual outlet pressure of the hydro machine and/or for controlling the actual delivery volume of the hydro machine and/or for controlling an actual torque of the hydro machine, and the amplification factor is a function of an actual temperature and/or of an actual rotating speed of the hydro machine and/or of the actual outlet pressure of the hydro machine and/or of a nominal pressure gradient of the hydro machine.

13. The hydraulic pressurizing medium supply assembly according to claim 1, wherein a neutral current of the pilot valve is pre-controlled.

14. The hydraulic pressurizing medium supply assembly according to claim 1, wherein:

a valve slide of the pilot valve is actuated in such a manner that the valve slide temporarily or continually carries out an axial oscillating movement, and a frequency and an amplitude of the axial oscillating movement is controllable as a function of the actual outlet pressure.

15. A method of operating a hydraulic pressurizing medium supply assembly, comprising:

controlling a pilot valve by way of a first closed-loop control circuit and a second closed-loop control circuit, wherein the hydraulic pressurizing medium supply assembly includes:

a hydro machine;

an adjusting mechanism including (i) an actuating cylinder having a set piston configured to adjust a delivery volume of the hydro machine, and (ii) the pilot valve electrically actuatable in a proportional manner, wherein an inflow to and/or an outflow from a control chamber of the actuating cylinder that is limited by the set piston is configured for control via the pilot valve in order for an actuation of the set piston to be impinged with pressurizing medium; and an electronic control which, as input variables, has at least a nominal outlet pressure of the hydro machine and/or a nominal delivery volume or a nominal swivel angle of the hydro machine, and which, as an output variable, has a control variable for the pilot valve, wherein the electronic control has the first closed-loop control circuit for an actual outlet pressure of the hydro machine and/or for an actual delivery volume or an actual swivel angle of the hydro machine, wherein the electronic control, so as to underlie the first closed-loop control circuit, has the second closed-loop control circuit for a delivery-volume adjustment rate or a swivel-angle adjustment rate of the hydro machine, wherein the second closed-loop control circuit, as an input variable, having an actual delivery-volume adjustment rate or an actual swivel-angle adjustment rate of the hydro machine, and, as an output variable, having the control variable for the pilot valve, and wherein the second closed-loop control circuit is supplied a control value from the first closed-loop control circuit in the form of a nominal delivery-volume adjustment rate or a nominal swivel-angle adjustment rate.

* * * * *